United States Patent [19]

Fletcher et al.

[11] 3,931,516

[45] Jan. 6, 1976

[54] MOVING PARTICLE COMPOSITION ANALYZER

[76] Inventors: James C. Fletcher, Administrator of the National Aeronautics and Space Administration, with respect to an invention of; Siegfried O. Auer, Lanham, Md.

[22] Filed: Aug. 30, 1974

[21] Appl. No.: 502,124

[52] U.S. Cl. ..... 250/281; 250/287; 250/288; 250/385; 250/423

[51] Int. Cl.[2] ..... H01J 39/34

[58] Field of Search ..... 250/281, 282, 283, 287, 250/288, 423, 424, 382, 385, 389, 394, 395

[56] References Cited

UNITED STATES PATENTS 3,715,590 2/1973 Auer ..... 250/287

*Primary Examiner*—Craig E. Church

*Attorney, Agent, or Firm*—Robert F. Kempf; Ronald F. Sandler; John R. Manning

[57] ABSTRACT

Mass spectrometry apparatus for analyzing the composition of moving microscopic particles includes a capacitor having a front electrode upon which the particles impinge, a back electrode, and a solid dielectric sandwiched between the front and back electrodes. In one embodiment, the electrodes and dielectric are arcuately shaped as concentric peripheral segments of different spheres having a common center and different radii. The front electrode and dielectric together have a thickness such that an impinging particle can penetrate them. The front electrode is negatively biased relative to the back electrode so that an impinging particle causes the front and back electrodes to become electrically connected to form a discharge spark between the electrodes. The discharge spark causes ejection from the front electrode of positive ions of elements in the impinging particle. An electric field is formed in front of the front electrode by a grid that is pervious to the particles and ions. The grid is negatively biased relative to the front electrode to draw the ejected positive ions away from the front electrode, so they impinge on a positive ion detector target. The arrival time of different ions is measured to complete the analysis. In a second embodiment, the capacitor has planar, parallel electrodes, in which case the ejected positive ions are deflected downstream of a planar grid by a pair of spaced, arcuate capacitor plates having a region between them through which the ejected ions travel.

13 Claims, 2 Drawing Figures

TRANSIENT DIGITIZER TIME ANALYZER
START
ION DET.
ION DET.

MOVING PARTICLE COMPOSITION ANALYZER

ORIGIN OF THE INVENTION

The invention described herein was made in the performance of work under a NASA contract and is subject to the provisions of Section 305 of the National Aeronautics and Space Act of 1958, Public Law 85-568 (72 STAT 435; 42 USC 2457).

FIELD OF THE INVENTION

The present invention relates generally to analyzers for microscopic particles, and more particularly, to a microscopic particle analyzer including a charged capacitor for ejecting positive ions of the microscopic particles impinging on an electrode of the capacitor.

BACKGROUND OF THE INVENTION

Devices have been developed to determine and analyze the composition of microscopic particles, such as interplanetary micrometeoroids, cometary dust, galactic dust, solar dust, particles orbiting a planet (such as the particles in the rings of Saturn), droplets in clouds of planetary atmospheres, and earth orbiting debris from any one of (1) nuclear weapon explosions, (2) rocket exhaust, (3) explosions of spacecraft, (4) rockets, (5) volcano eruptions, as well as ejecta from hypervelocity impacts of missiles or jet engine exhaust. The composition of these particles has been determined by utilizing mass spectrometry apparatus for analyzing the abundancy of elements and isotopes of the elements in the particles. Such analyzers are disclosed in my U.S. Pat. No. 3,715,590, as well as in the article entitled "Detection Technique For Micrometeoroids Using Impact Ionization," written by Siegfried Auer and Kurt Sitte, which appeared in Earth and Planetary Science Letters, 1968, Volume 4, Pages 178–183.

In the prior art devices, a microscopic particle impacts on a front face of an electrically biased metallic surface, which may be tungsten. In response to the impact, positive ions are derived from the front face and directed to an ion detector by an electrostatic field established by a particle and ion pervious grid electrode that is negatively biased relative to the impact surface. The kinetic energy of an impacting particle on the metal surface results in a portion of the particle being vaporized and ionized. Since only the kinetic energy of an impacting particle causes vaporization and ionization, the prior art device has a relatively low efficiency, particularly for relatively slow impact velocities (less than five kilometers per second). The conversion of particle material to vapor and ions is considered to be of relatively low efficiency because only a small fraction (considerably less than one percent and approximately 0.001 percent) of the atoms in an impacting particle are ionized.

A further deficiency in the prior art detector is that solid fragments of the particle may impact on metal parts, other than the impact surface, that are located in a housing for the impact surface. In response to an impact on metal parts other than the impact surface, fragmentary particles are produced that have a tendency to reach the impact surface slightly after the impact of the main part of the particle; thereby, ions are derived from the impact surface at slightly displaced time intervals. Because of the different travel times of ions of different elements from the impact surface to an ion detector, it is difficult, and frequently impossible, to distinguish between ions derived from the main part of the particle and from fragments, with a resultant confusion in analysis of the particle composition. Thus, a phenomenon known as 'ghost " is frequently a problem with the prior art devices.

A further deficiency in the prior art device is that the elements in the particle which can be ionized most readily are over-represented in a mass spectrum derived from the ions. In particular, alkaline metals are always over-represented, except for particles having very high impact velocities (in excess of approximately twenty kilometers per second). Because alkalines are always over-represented, large corrections and therefore uncertainties, are necessary, based on considerations of plasma equilibrium conditions, to determine the correct proportions of the elements in the impacting particles. Alkaline elements are always over-represented with the prior art device because the particles almost invariably have some alkalines therein. The alkalines have a lower work function than other elements in the particle and are, thereby, more easily ionized. Once one alkaline ion is generated, it has a tendency to ionize additional alkaline atoms in the particle, with a resulting regenerative effect.

BRIEF DESCRIPTION OF THE INVENTION

In accordance with the present invention, a major fraction (between 10 and 100 percent) of the atoms in a microscopic particle impacting on a particle receiving surface are ionized. The result is achieved by adding the potential energy of a charged capacitor to the kinetic energy of the impacting particle. The capacitor includes a front electrode upon which the particle impacts, a rear electrode, and a solid dielectric sandwiched between the front and rear electrodes. The front electrode and dielectric together have a thickness such that an impinging microscopic particle can penetrate them, a result preferably achieved by forming the front electrode from a thin metal film, having a thickness typically on the order of one-tenth micron, which is deposited on an oxide dielectric layer, having a thickness between 0.4 and 1 micron, that is formed on a doped semiconductor substrate that comprises the rear electrode. In response to a particle impacting on the front electrode, the front and back electrodes become electrically connected to form a discharge spark between the two electrodes. The discharge spark causes positive ions to be ejected from the front electrode. The positive ions are of elements in the impinging particle, as well as elements contained in the materials of the capacitor. Thereby, it is preferable to employ capacitor materials that do not include elements that are normally expected in the particles to be analyzed. If the particles to be analyzed are of outer space origin, the metal film may, therefore, be a noble metal, the back electrode may be a P-doped germanium substrate and the dielectric a germanium oxide, such as GeO. A narrow oxide dielectric layer is also advantageous in this regard because it contains a relatively small number of oxygen atoms and there is consequently a relatively small number of oxygen ions ejected from the front electrode. The use of germanium and germanium oxide as the back electrode and dielectric is preferable because of the advanced state of the technology for these materials, and because germanium is believed to be virtually non-existent in outer space.

To enable positive ions to be ejected from the front electrode of the capacitor, the front electrode is negatively biased relative to the back electrode. The positive ions ejected from the front electrode are drawn from the front electrode by an electric field that is provided in front of the front electrode. The electric field is established by a grid that is pervious to the particles, as well as to the ions, and which is positioned between the front electrode and an ion detector that is biased so that substantially all ions passing through the grid travel to the ion detector. In a preferred configuration, the front and back electrodes, as well as the dielectric and grid, are arcuately shaped as concentric peripheral segments of different spheres having a common center and different radii. The detector is located approximately at the common center of the different spheres so that substantially all of the ions ejected from the front electrode impinge on the ion detector with a minimum amount of focusing required.

I am aware of capacitor-type micrometeoroid detectors being used in the past to indicate the presence of a micrometeoroid. The capacitor electrodes have been biased so that the front electrode was positive relative to the rear electrode so that positive ions could not be derived from the front electrode in response to micrometeoroid impacts. It was, apparently, not previously appreciated that biasing the front electrode negatively relative to the back electrode would produce positive ions that could be drawn from the front electrode and enable the composition of an impacting particle to be determined.

The structure of the present invention provides for the substantial elimination of ghost images which were prevalent in the prior art. This is because of the relatively slow response time of the capacitor, whereby the capacitor is so completely discharged in response to an impacting particle that it cannot recover for approximately ten to one hundred milliseconds subsequent to the impact. Thereby, ions derived from the front electrode as a result of fragments of the same particle which caused an initial ionization are not produced in sufficient quantities relative to the number of ions resulting from the initial impact to be detected.

By converting a major fraction, and perhaps all, available atoms in the particle into ions, the signal-to-noise ratio of the detected mass spectrum is improved by orders of magnitude over the prior art. Thereby, the need for complex and costly electronic circuitry is obviated. Also, because of the large quantity of ions derived, mass spectrometers having a high resolving power but low transmission, such as mass spectrometers including ion deflecting means, can be utilized.

In contrast to the prior art, the chemical constituents of an impacting particle are represented by the generated ion mass spectrum in approximately the correct proportions, particularly if the capacitor is fabricated from compositions other than those which are normally expected in the particles to be analyzed.

The present invention is also applicable to analyzing particles having relatively low impact velocity (as low as or probably lower than one kilometer per second) because the capacitor supplies potential energy to the impacting particle, which is added to the relatively low kinetic energy of such particles.

It is, accordingly, an object of the present invention to provide a new and improved mass spectrometry apparatus for analyzing the composition of microscopic particles moving relative to the apparatus.

An additional object of the invention is to provide a relatively efficient device for analyzing the composition of relatively low velocity microscopic particles.

Another object of the invention is to provide an apparatus for analyzing the composition of microscopic particles wherein the kinetic energy of the particle is combined with the potential energy of a capacitor to effect conversion of a relatively large number of atoms in the particles into ions.

A further object of the invention is to provide a new and improved apparatus for analyzing the composition of microscopic particles wherein the effects of ghost mass spectra are substantially eliminated.

Still another object of the invention is to provide an apparatus for analyzing the composition of microscopic particles wherein ions derived in response to the particles impinging on the apparatus accurately represent the constituents of the particle.

The above and still further objects, features and advantages of the present invention will become apparent upon consideration of the following detailed description of several specific embodiments thereof, especially when taken in conjunction with the accompanying drawing.

DETAILED DESCRIPTION OF THE DRAWING

Figures 1, 2:
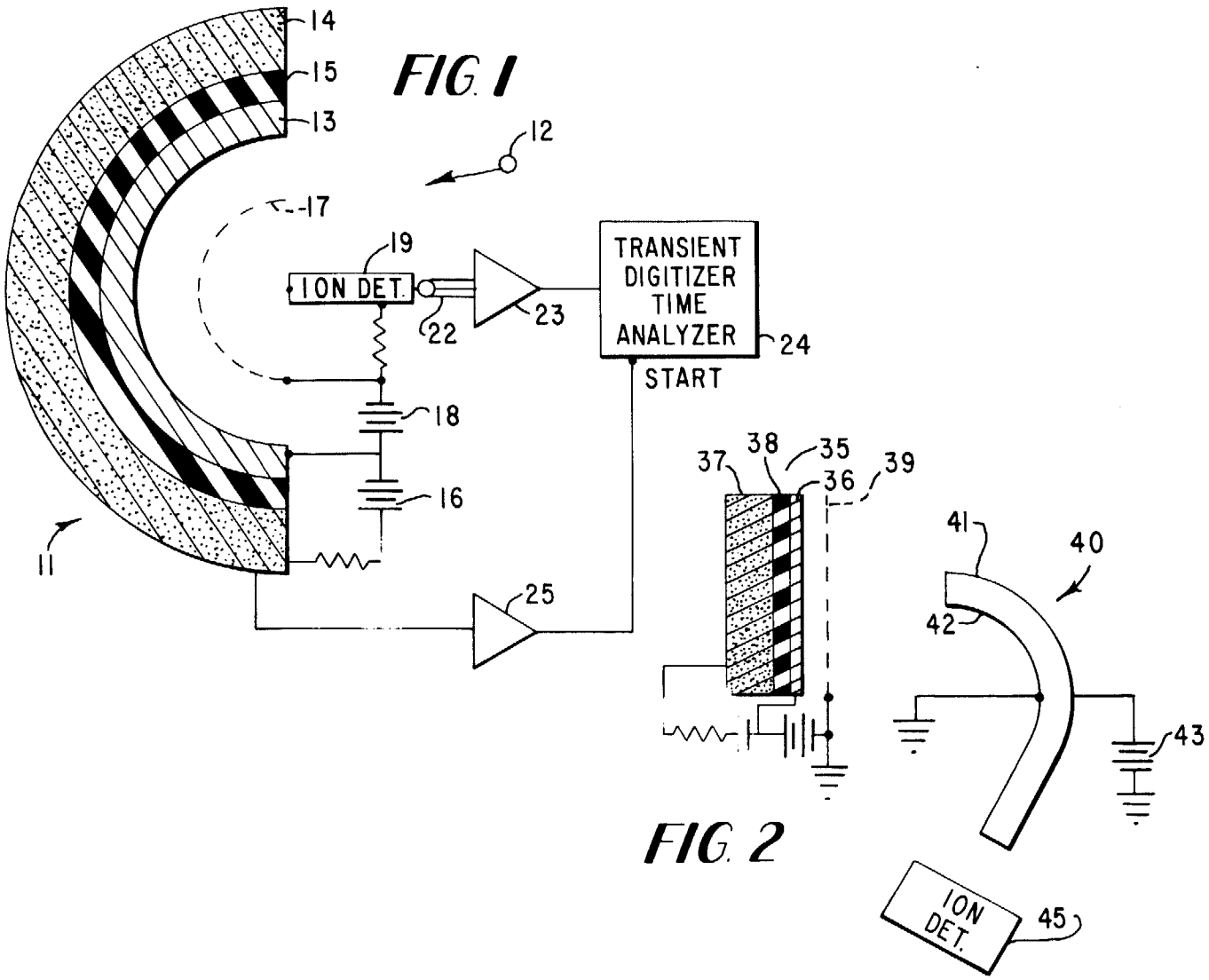
FIG. 1 is a side-sectional view of a first embodiment of the present invention.
FIG. 2 is a side-sectional view of a second embodiment of the present invention.

Reference is now made to FIG. 1 wherein there is illustrated a side-sectional view of one embodiment of a capacitor 11 for ionizing a significant portion of microscopic particles, such as micrometeoroid 12, which move relative to the capacitor 11 and impinge thereon. Capacitor 11 includes a front electrode 13, a back electrode 14 and a dielectric layer 15 sandwiched between electrodes 13 and 14. Electrode 13 and dielectric layer 15 together have a thickness such that impinging particle 12 can penetrate them. A typical thickness for electrode 13, which is preferably formed as a thin metallic film that is deposited, e.g., by vacuum vapor techniques on layer 15, is on the order of 0.1 microns. A typical thickness of dielectric layer 15, which is preferably an oxide of a substrate forming electrode 14, is in the range of 0.4 to 1 microns. Dielectric layer 15 is formed on substrate 14 by typical firing or sintering oxidation techniques. Substrate 14 is preferably a P-doped semiconductor having sufficient conductivity to enable it to function as an electrode.

The materials employed in capacitor 11 preferably differ from those expected in the particle 12 to be analyzed. If the device is employed for analyzing outer space particles, where noble metals and germanium do not occur, film 13 is preferably selected from any of the noble metals, while substrate 14 is P-doped germanium and oxide layer 15 is an oxide of germanium, e.g., GeO. Gold is particularly well suited for film 13 because of its ability to adhere to layer 15.

To enable positive ions to be ejected from front electrode 13 in a direction toward the source of particle 12, capacitor 11 is biased so that front electrode 13 is at a negative potential relative to back electrode 14, a result achieved by connecting the negative and positive terminals of D.C. power supply 16 to electrodes 13 and 14, respectively, so that a D.C. voltage of approximately forty volts exists between the electrodes. A particle 12 impacting on front electrode 13 penetrates through layers 13 and 15 causing electrodes 13 and 14 to be electrically connected together, whereby a spark discharge is formed between the electrodes. The spark discharge causes positive ions to be ejected in a direction away from front electrode 13 and layer 15, i.e., in a direction generally toward the origin of particle 12.

To draw the ejected positive ions away from the front electrode, a metal grid 17, pervious to particle 12 and the positive ions ejected away from electrode 13, is positioned in front of electrode 13. Grid 17 is biased negatively relative to electrode 13, a result achieved by respectively connecting positive and negative terminals of D.C. power supply 18 to electrode 13 and 17. Grid 17 and D.C. power supply 18 thereby establish an electric field in front of front electrode 13 to positively draw the positive ions away from front electrode 13 and into the region to the right of grid 17, as viewed in FIG. 1.

The positive ions passing through grid 17 are directed to an ion detector 19 that is at a focal point for ions ejected from front electrode 13. Ions passing through grid 17 drift to ion detector 19, a result achieved by maintaining a housing of the ion detector at the same potential as grid 17, as is accomplished by connecting the housing to the negative terminal of power supply 18 through relatively large resistor (e.g., 1 megohm) 20. In the alternative, ions penetrating grid 17 are accelerated to ion detector 19, a result achieved by biasing the housing of ion detector 19 negatively relative to grid 17.

In experiments that have been conducted, it has been found that the number of positive ions ejected away from front electrode 13 toward grid 17 is approximately equal to the number of atoms in a microscopic particle 12 impacting on front electrode 13 and penetrating through dielectric layer 15. The positive ions produce an ion current pulse that has been found to have a peak value on the order of ten to fifty amperes and a duration on the order of 100 nano-seconds. The ten to 50 ampere ion current is to be contrasted with ion currents of approximately 100 nano-amperes, as derived by prior art devices which relied exclusively on kinetic energy of an impinging particle, rather than a combination of the kinetic energy of the particle and the potential electric energy between electrodes 13 and 14. The ion current can generally be considered as having two approximately equal contributions respectively derived from atoms in particle 12, and atoms spewed from elements in capacitor 11. By forming capacitor 11 of materials that are not expected to be in the particle, it is possible to easily distinguish between the two different types of ions because the masses thereof are different, with a resulting difference in arrival times at ion detector 19 of the ions of the particle and capacitor. Since the elements of the capacitor are known the responses thereof from the ion detector can be ignored.

To provide simple apparatus for focusing of ions ejected from front electrode 13, the front and back electrodes 13 and 14, as well as dielectric 15 and grid 17, are arcuately shaped as concentric peripheral segments of different spheres having a common center and different radii. Preferably, to enable capture of the greatest number of particles, all of the elements of the capacitor and grid 17 are hemispherical in shape. Ion detector 19 is located at the common center of the segmented spheres forming electrodes 13 and 14, dielectric 15 and grid 17. Ion detector 19 is preferably a Faraday couple formed as a metal plate positioned behind a screen through which the ions can easily penetrate. The plate may be formed as a honeycomb structure for trapping secondary electrons emitted in response to the ions impinging on the plate. The plate is connected to a center conductor of a coaxial cable 22 that is connected between input terminals of a high input impedance amplifier 23.

Amplifier 23 is connected to a suitable pulse time detecting analyzer 24, either via a hard wire connection or through an R.F. link. A typical analyzer is a Tektronix transient digitizer type R-7912, which includes a storage tube having a face on which pulses are derived in a pair of orthogonal, X–Y directions. The output of amplifier 23 is applied to a Y input terminal of the storage tube, while a time base sweep in the *x* direction is instigated in response to particle 12 impinging upon ionization source 11. To instigate the time base sweep, analyzer 24 includes a start input terminal that is connected to be responsive to the output of amplifier 25, having an input connected to electrode 14, whereby a pulse is supplied by electrode 14 to the input of amplifier 25 immediately upon particle 12 impinging upon ionization source 11.

Ions of different mass impinge on ion detector 19 at different times, whereby pulses are supplied to the Y input of the storage tube included in analyzer 24 at different times. The time of arrival of the pulses at ion detector 19 relative to the impact time of particle 12 provides an indication of the mass of the ions received by detector 19 and thereby of the constituent atoms of particle 12. The spherical configuration of the capacitor forming ionization device 11, in addition to providing a simple apparatus for focusing ions on detector 19, provides a constant distance from all portions of electrode 13 to ion detector 19. Thereby, all ejected ions have the same travel distance to ion detector 19 and a very precise representation of the constituent elements in particle 12 can be determined by comparing the occurrence times of a pulse detected from electrode 14 and the pulse arrival times at ion detector 19.

In response to a particle impacting on electrode 13 and penetrating through layer 15, there is a substantial dissipation of the charge existing between electrodes 13 and 14 prior to the impact. In experiments that have been conducted, it has been determined that between ten and one hundred milliseconds are required to recharge electrodes 13 and 14 to a potential that enables a high percentage of the atoms in an impacting particle to be ionized. Because of the relatively long recovery time of capacitor 11 before it can again assist in materially ionizing additional particles, ghost spectra are avoided. This is because ions or particles which may impinge on electrode 13 as a result of fragments from the particle 12 impinging on other parts of the device result in a relatively small number of ions being ejected from front electrode 13 to ion detector 19.

Experiments conducted with the apparatus of FIG. 1 have revealed that, aside from the ions resulting from the materials in capacitor 11, the number of ions for the different masses in particles 12 are approximately proportional to the number of atoms in the particle. Alkaline ions were not found to exist, unless alkaline atoms were in the particle, in contrast to the prior art devices. If alkaline atoms exist in the particle, the number of alkaline ions was found to be proportional to the number of alkaline atoms therein, and not over represented, as in the prior art.

In accordance with a further embodiment of the invention, as illustrated in FIG. 2, there is provided a parallel plate capacitor 35 including front thin film, metal electrode 36, rear P-doped semiconductor electrode 37 and a solid semiconductor oxide dielectric layer 38, instead of arcuately shaped capacitor 11. Positioned in front of electrode 36 is planar screen grid 39. Electrodes 36 and 37, and screen grid 39 are all parallel to each other to enable the mass of positive ions ejected from capacitor 35 to be detected. Ions of different masses are deflected by differing amounts by providing an ion deflection means 40 that comprises a pair of spaced, arcuate, metal capacitor plates 41 and 42 having a region between them through which the positive ions travel. Plates 41 and 42 provide approximately a 130° rotation for positive ions ejected from capacitor 35 that traverse an entrance plane between plates 41 and 42 that is parallel to the plane of electrode 36 and therefore generally transverse to ions crossing the entrance plane. Each of plates 41 and 42 includes a curved circular segment immediately downstream of the entrance plane. The two curved segments are peripheral segments of circles having different radii and a common center, with both curved segments subtending an arc of approximately 130°. Outer plate 41 is positively biased relative to inner plate 42 by a suitable D.C. source 43. Plates 41 and 42 include parallel straight portions downstream of the curved portions to guide the deflected positive ions to detector 45, which can be constructed identically to detector 19.

While there have been described and illustrated several specific embodiments of the invention, it will be clear that variations in the details of the embodiments specifically illustrated and described may be made without departing from the true spirit and scope of the invention as defined in the appended claims.

What is claimed is:

1. Apparatus for enabling an analysis to be performed of the composition of microscopic particles moving relative to the apparatus comprising a capacitor having: a front electrode upon which the particles impact, a back electrode, and a solid dielectric sandwiched between the front and back electrodes, said front electrode and the dielectric together having a thickness such that an impinging particle can penetrate them; means for biasing said front electrode negatively relative to said back electrode, whereby an impinging particle results in positive ions of the impacting particle being ejected from the front electrode, means for providing an electric field in front of the front electrode to draw the ejected positive ions derived from the front electrode away from the front electrode, and a positive ion detector located to be responsive to the ions drawn from the front electrode.

2. The apparatus of claim 1 wherein said front and back electrodes and said dielectric are arcuately shaped as concentric peripheral segments of different spheres having a common center and different radii, said detector being located approximately at the common center.

3. The apparatus of claim 2 wherein said means for providing the electric field includes a metal grid positioned in front of the front electrode, said grid being pervious to the particles and ions, said grid being arcuately shaped as a peripheral segment of a further sphere having the same center as the common center and a radius less than the radii of the electrodes and dielectric.

4. The apparatus of claim 1 further including means for analyzing the transit time between the front electrode and detector of different positive ions resulting from the same impacting particles.

5. The apparatus of claim 4 further including means connected to the capacitor for deriving a start signal in response to formation of the spark, wherein said means for analyzing includes means for instigating a time base in response to the start signal.

6. The apparatus of claim 1 wherein said means for providing the electric field includes a metal grid positioned in front of the electrode and pervious to the particles and ions, means for biasing the grid negatively relative to the front electrode, and means for biasing the ion detector so that substantially all ions passing through the grid travel to the detector.

7. The apparatus of claim 6 wherein the means for biasing the ion detector establishes an ion drift region between the grid and detector.

8. The apparatus of claim 1 wherein the electrodes and dielectric are fabricated from compositions other than those normally expected in the particles to be analyzed.

9. The apparatus of claim 8 wherein the particles are micrometeoroids, the back electrode is P-doped germanium and the dielectric is an oxide of germanium.

10. The apparatus of claim 9 wherein the front electrode is a noble metal thin film.

11. The apparatus of claim 1 further including means positioned between the front electrode and detector for deflecting ejected positive ions having different masses by differing amounts.

12. The apparatus of claim 11 wherein the deflecting means includes a pair of spaced, arcuate capacitor plates having a region between them through which the positive ions travel.

13. The apparatus of claim 11 wherein the electrodes and dielectric are flat and lie in parallel planes.

* * * * *